US007358926B2

(12) United States Patent
Komoto et al.

(10) Patent No.: US 7,358,926 B2
(45) Date of Patent: Apr. 15, 2008

(54) ANTENNA DEVICE

(75) Inventors: Shinzo Komoto, Okayama (JP); Hideto Sadamori, Okayama (JP); Setsuo Takesako, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 91 days.

(21) Appl. No.: 11/398,722

(22) Filed: Apr. 6, 2006

(65) Prior Publication Data

US 2006/0227055 A1 Oct. 12, 2006

(30) Foreign Application Priority Data

Apr. 7, 2005 (JP) ..... 2005-110615

(51) Int. Cl.
*H01Q 9/30* (2006.01)

(52) U.S. Cl. ..... 343/900; 343/702

(58) Field of Classification Search ..... 343/900, 343/702, 882, 889

See application file for complete search history.

(56) References Cited

U.S. PATENT DOCUMENTS 5,909,653 A * 6/1999 Imura et al. ..... 455/575.7
6,380,897 B1 * 4/2002 Shaw et al. ..... 343/702

FOREIGN PATENT DOCUMENTS

JP 5-055817 3/1993

* cited by examiner

*Primary Examiner*—Trinh Dinh
*Assistant Examiner*—Dieu Hien T Duong
(74) *Attorney, Agent, or Firm*—Wenderoth, Lind & Ponack, L.L.P.

(57) ABSTRACT

An antenna device is provided that is preferably used for various wireless devices such as television receivers and the like. An antenna rod can be stopped at a predetermined angle position via a hinge mechanism. The antenna device includes a hinge mechanism by which a biasing force of a coil spring stored in an antenna base causes an upper end of a circular-cylindrical projection of an abutting member to be abutted with an end face of a projection section of an intermediate member fixed to a lower part or antenna rod, thereby stopping the antenna rod at a predetermined angle position. When the antenna rod is moved to a different angle position, the abutting member has a biased movement in the downward direction. This can suppress the wear of the circular-cylindrical projection.

19 Claims, 8 Drawing Sheets

FIG. 7 – PRIOR ART
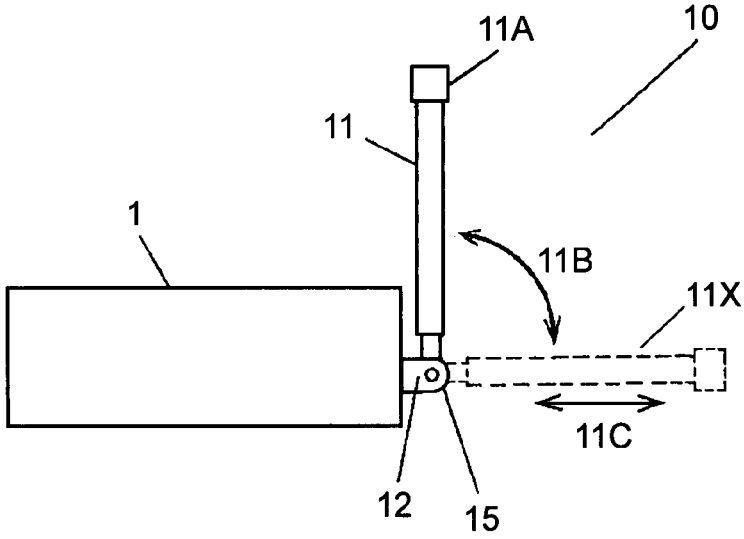
FIG. 8 – PRIOR ART
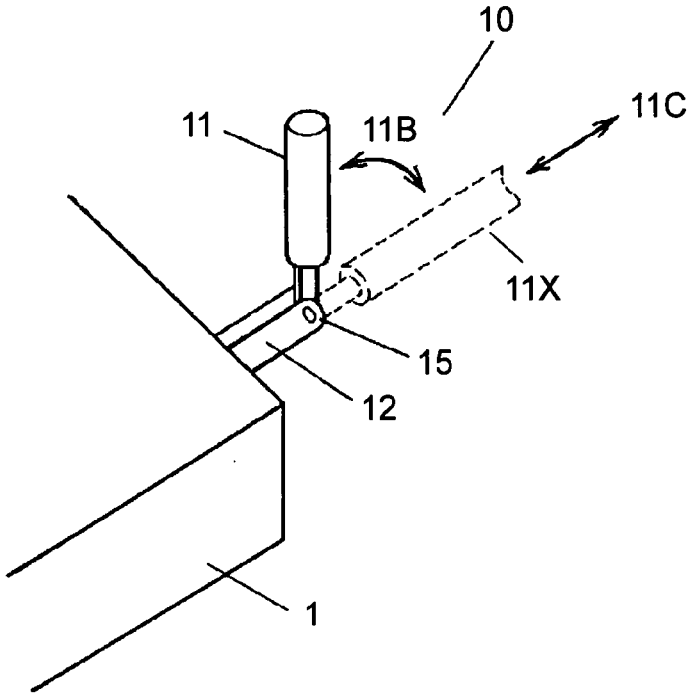

FIG. 9 – PRIOR ART
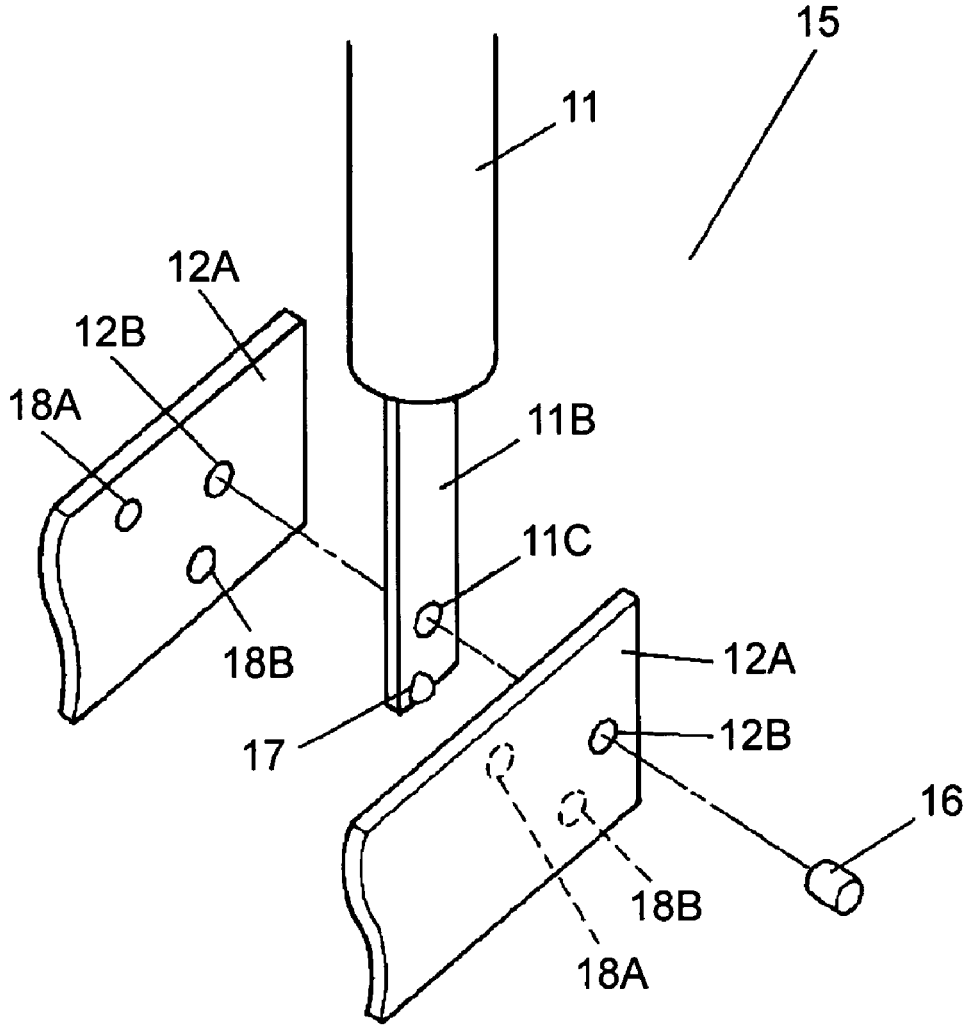

ANTENNA DEVICE

TECHNICAL FIELD

The present invention relates to an antenna device to be attached to any of various wireless devices such as television receivers and radio receivers for example.

BACKGROUND ART

FIG. 7 is a side view illustrating a wireless device attached with a conventional antenna device. Wireless device 1 is attached with so-called rod-type antenna device 10. Antenna device 10 is composed of antenna base 12 and antenna rod 11. At a tip end of antenna rod 11, knob section 11A is provided. Antenna base 12 is provided, for example, at a side face of wireless device 1 having a box body or a chassis so that antenna base 12 protrudes from the side face. Antenna base 12 is connected to antenna rod 11 via hinge mechanism 15. Hinge mechanism 15 allows antenna rod 11 to be turned in turning direction 11B.

FIG. 8 is a perspective view of the wireless device attached with antenna device 10 as shown in FIG. 7. In FIG. 8, the same components as those of FIG. 7 are denoted with the same reference numerals.

FIG. 9 is an exploded perspective view of hinge mechanism 15 shown in FIG. 7 and FIG. 8. Hinge mechanism 15 includes connection plate 11B that is provided at the lower end of antenna rod 11 and that has a flat plate-like shape formed in a protruded manner. Hinge mechanism 15 also includes: a pair of sandwiching plates 12A that sandwich both side faces of connection plate 11B and that are provided at the tip end of antenna base 12; and axial support pin 16 that is inserted into penetration holes 12B and 11C provided in sandwiching plate 12A and connection plate 11B and that allows antenna rod 11 to be turned around or fixed to antenna base 12.

At front and back faces of connection plate 11B, convex sections 17 are separately provided, respectively. At the respective inner faces of sandwiching plates 12A, first concave sections 18A are provided. Convex sections 17 are fitted into first concave sections 18A when antenna rod 11 is turned in the same direction as that of the center line of a direction along which antenna base 12 extends. At the respective inner faces of sandwiching plates 12A, second concave sections 18B are also provided. Convex sections 17 are fitted into second concave sections 18B when antenna rod 11 is turned to a position at which antenna rod 11 is upwardly orthogonal to the direction along which antenna base 12 extends.

When not in use, antenna rod 11 is turned via hinge mechanism 15 to a position in the same direction as that along which antenna base 12 extends. At this position, convex sections 17 of hinge mechanism 15 are fitted into first concave sections 18A. Thus, antenna device 10 can be stored in wireless device 1 along telescopic direction 11C except for knob section 11A of the tip end of antenna rod 11.

When antenna device 10 is to be used, antenna rod 11 and antenna base 12, which are stored so that the center lines thereof are on a single straight line, are pulled out from wireless device 1 by grabbing and pulling knob section 11A. As a result, as shown in FIG. 7 and FIG. 8, antenna rod 11 is turned in a direction that is upwardly orthogonal to the direction along which antenna base 12 extends. Specifically, antenna rod 11 is turned in turning direction 11B so that antenna device 10 is used in a fixed condition in which convex sections 17 of hinge mechanism 15 are fitted into second concave sections 18B, respectively.

Conventional antenna device 10 as described above has been structured so that convex sections 17 of hinge mechanism 15 are respectively fitted into concave section 18A and 18B to allow antenna rod 11 to stop at a position with a predetermined angle. However, this structure causes, when convex sections 17 are respectively moved between concave sections 18A and concave sections 18B, convex sections 17 to move while respectively being abutted with opposed inner surfaces of sandwiching plate 12A. This causes wear of convex sections 17 and concave sections 18A and concave sections 18B, respectively. An increased frequency at which antenna device 10 is used in particular increases the wear of convex sections 17 and concave sections 18A and concave sections 18B, which finally causes an inconvenience where antenna rod 11 cannot be fixed to antenna base 12 at a predetermined position. Japanese Patent Unexamined Publication (Japanese Patent Application No. 5-55817) is known as a background art document.

SUMMARY OF THE INVENTION

The present invention solves the above-described inconvenience of the background art. The present invention provides an antenna device that can stop, via a hinge mechanism, an antenna rod at a predetermined angle position for a long time and in a stable manner and that suppresses the wear of the hinge mechanism.

A specific antenna device of the present invention has a hinge mechanism by which an antenna rod can be stopped at a predetermined angle relative to an antenna base. In the hinge mechanism, elastic material is stored in a hollow provided in the antenna base while being deflected. An abutting member is also provided that is biased, by the elastic material, toward the antenna rod. The abutting member is abutted with an end section of the antenna rod to allow the antenna rod to stop at a predetermined angle position for a long time and in a stable manner.

By the hinge mechanism by which the biasing force of the elastic material can cause the abutting member to be abutted with the antenna rod to stop the antenna rod for a long time and in a stable manner, the abutting member can be moved in a direction along which the elastic material is further deflected. This provides, even when an angle position at which the antenna rod is stopped is changed by a user, a biased movement of the abutting member (i.e., sliding of the abutting member) to suppress the wear of the abutted position. This can stop the antenna device at a determined angle position for a long time and in a stable manner.

In another antenna device of the present invention, the lower end of the antenna rod is coupled with an intermediate member. The intermediate member has a projection section that is projected toward the lower side of the antenna rod and that has a substantially-polygonal shape when seen from a side. An abutting member is abutted with an end face of a side forming the substantially-polygonal shape of the projection section to stop the antenna rod at the angle position. Since the intermediate member can be provided by material having a high strength, a wireless device can be prevented from being damaged or broken even when a user drops the wireless device. Furthermore, when a plurality of intermediate members having projection sections having different shapes are selectively attached to one antenna rod, a few types of antenna devices by which the antenna rod is stopped at different angle positions can be provided. This expands the range of applications of the antenna device to various wireless devices.

In still another antenna device of the present invention, the projection section of the intermediate member has a regular polygon-like shape having a center at the turning center of the antenna rod. This always equalizes click feelings and feelings obtained when the angle position of the antenna rod is changed during use. Thus, sense of discomfort during the operation of the antenna device can be eliminated.

In still another antenna device of the present invention, the elastic material is a coil spring. The elastic material as described above can be easily installed in an antenna base having a substantially bar-like shape and provides a biased status of the abutting member in a stable manner and for a long time.

As described above, the present invention has the hinge mechanism by which the antenna rod can be stopped at a predetermined angle position in a stable manner while using the abutting member biased toward the antenna rod by the elastic material to allow the antenna rod to be abutted with the antenna rod at the end section thereof. This allows, when the antenna rod is moved to a different angle position, the abutting member to have a biased movement (i.e., the abutting member to move in response to the movement of the antenna rod to the different angle position), thus providing a smooth change of an angle position. This can provide an antenna device that suppresses mechanical wear caused by the abutment of the hinge mechanism so that the antenna rod can be stopped at a determined angle position for a long time and in a stable manner.

BRIEF DESCRIPTION OF THE DRAWINGS

FIG. 7 is a side view illustrating a wireless device attached with a conventional antenna device.

FIG. 8 is a perspective view illustrating the conventional antenna device.

FIG. 9 is an exploded perspective view illustrating a hinge mechanism of the conventional antenna device.

DETAILED DESCRIPTION OF PREFERRED EMBODIMENTS

Figure 1:
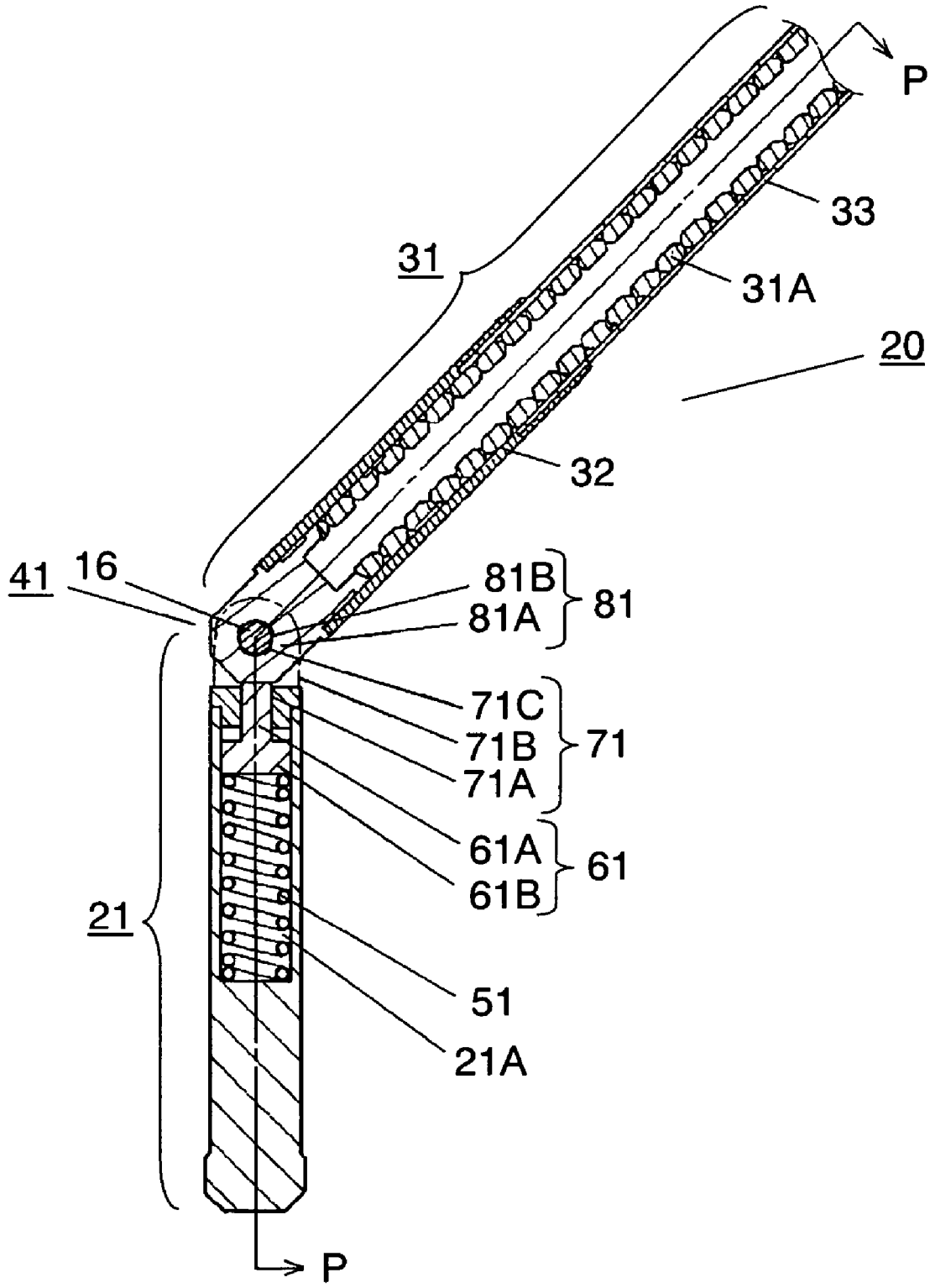
FIG. 1 is a cross-sectional view illustrating an antenna device according to one embodiment of the present invention.

One embodiment of the present invention will be described with reference to the drawings. It is noted that the same components as those of the conventional structure will be denoted with the same reference numerals and will not be described further.

FIG. 1 is a cross-sectional view illustrating an antenna device according to one embodiment of the present invention.

Antenna device 20 includes antenna base 21. A part of antenna base 21 attached to a wireless device has a substantially circular bar-like shape. Antenna rod 31 is connected to antenna base 21 via, for example, two-stage hinge mechanism 41 that is telescopically structured.

As in the conventional structure, when antenna device 20 is not used, antenna rod 31 is moved, via hinge mechanism 41, to a position at which the center line of antenna rod 31 and the center line of the antenna base 21 are on a single line and antenna rod 31 and antenna base 21 are stored in the wireless device. When antenna device 20 is to be used, antenna rod 31 is pulled out from the wireless device and is positioned, via hinge mechanism 41, to have a predetermined angle relative to antenna base 21.

Next, hinge mechanism 41 as the main part of antenna device 20 and the periphery thereof will be described. Antenna base 21 includes circular hollow 21A having a bottom. Circular hollow 21A is arranged to extend in a direction from an end face of antenna base 21 closer to antenna rod 31 toward the lower side. Circular hollow 21A stores therein coil spring 51. A washer provided at the lower part of coil spring 51 is provided so as to be abutted with the bottom section of circular hollow 21A.

On the washer placed on coil spring 51, circular base section 61B of abutting member 61 is provided. The outer circumference face of circular base section 61B is guided by the inner circumference face of circular hollow 21A and is designed to have a diameter and a thickness by which circular base section 61B can be moved in parallel with the direction along which circular hollow 21A is provided. Specifically, circular base section 61B can be slid in circular hollow 21A. At the center of the upper face of circular base section 61B, circular-cylindrical projection 61A protruding to the upper side is integrally formed. The upper end of circular base section 61B is protruded, by a predetermined length, from center penetration hole 71A of cover section 71. Cover section 71 is attached to the upper end of antenna base 21 so as to block circular hollow 21A.

Cover section 71 attached to antenna base 21 includes a pair of sandwiching plates 71B extending toward antenna rod 31. Sandwiching plates 71B include penetration holes 71C, respectively.

On the other hand, the lower outer circumference at the lower stage of antenna rod 31 (i.e., a part of antenna rod 31 closer to antenna base 21) is covered by metal tubular body 32. Metal tubular body 32 stores therein coil-like antenna element section 31A made of conductive wire. The upper outer circumference part of antenna element section 31A is covered by insulating tube 33.

Intermediate member 81 is made of metal and is integrated with tubular body 32 by being inserted to into the lower part of tubular body 32 to calk tubular body 32 in a fixed manner. The lower end of antenna element section 31A is abutted with the upper face of the stage at the inner periphery of intermediate member 81. Thus, intermediate member 81 also provides a function for preventing antenna element section 31A from being disengaged in the downward direction.

Intermediate member 81 also includes flat plate-like projection section 81A that is formed in a projected manner toward antenna base 21 (i.e., toward the lower side on the same center line as that of antenna rod 31). The lower part of projection section 81A is formed to partially have the shape of a regular polygon when seen in the side view.

Projection section 81A also includes penetration hole 81B at the center of the regular polygon. In one embodiment of the present invention, projection section 81A is formed to have a shape that is a half of a regular octagon from which corners are cut off, at 45 degree angles, from parallel opposed sides.

Figure 2:
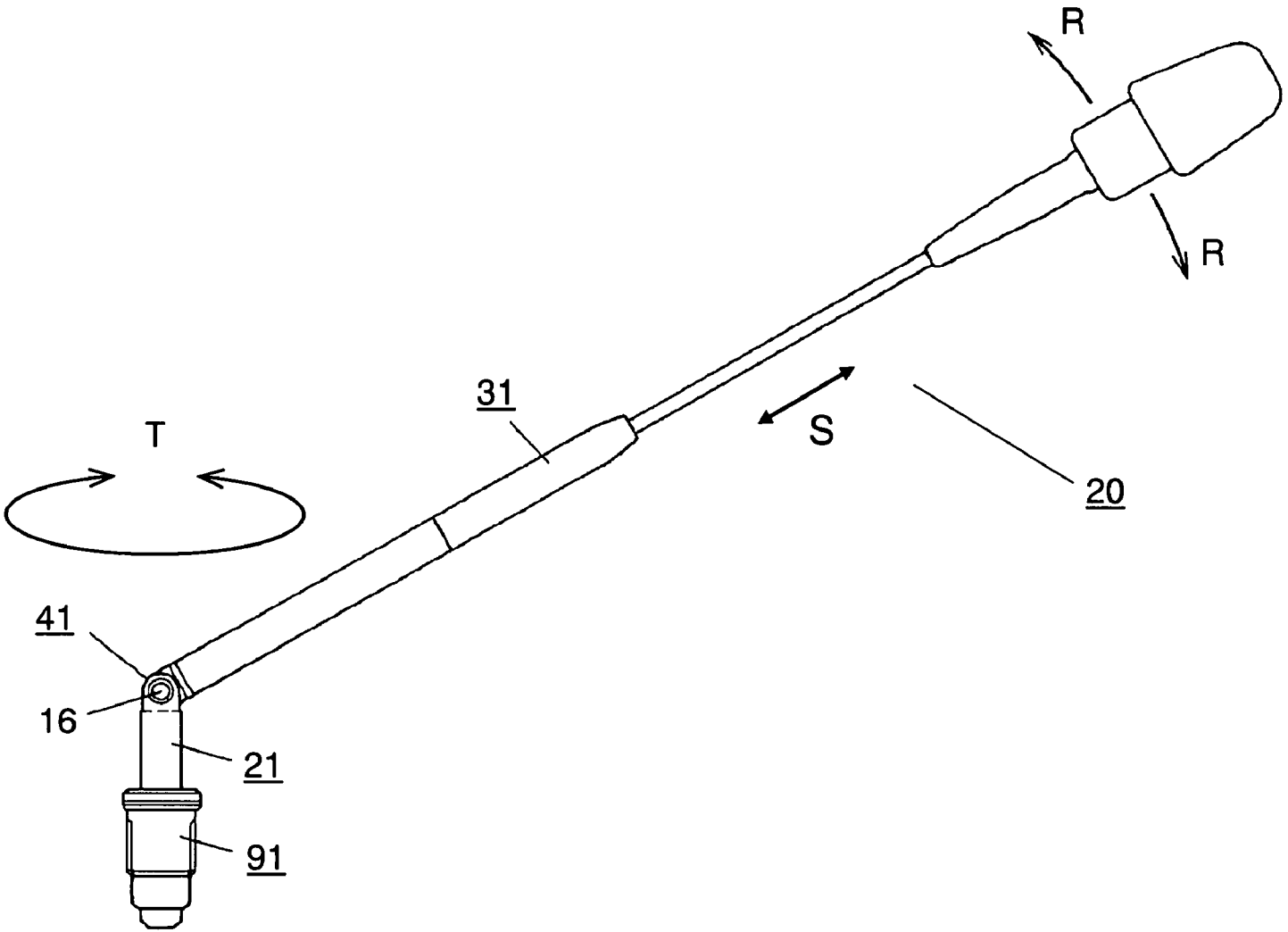
FIG. 2 is a perspective view illustrating the appearance of the antenna device according to the embodiment of FIG. 1.

FIG. 2 is a perspective view illustrating the appearance of the antenna device according to the present invention. Antenna device 20 includes antenna base 21. Antenna base 21 includes axial support pin 16 that is attached with hinge mechanism 41. Hinge mechanism 41 allows antenna rod 31 to be inclined in inclination direction R. Antenna rod 31 is connected, via hinge mechanism 41, to antenna base 21. When antenna rod 31 can have a telescopic movement as shown by telescopic direction S, antenna device 20 can be stored in a wireless device in a compact manner. The structure as described above is preferable because it can reduce a space of the wireless device required for storing antenna device 20. When antenna base 21 is inserted into tubular holder 91 fixed to the wireless device, antenna rod 31 also can be rotated around antenna base 21 as a rotation center in circumferential direction T.

Figure 3:
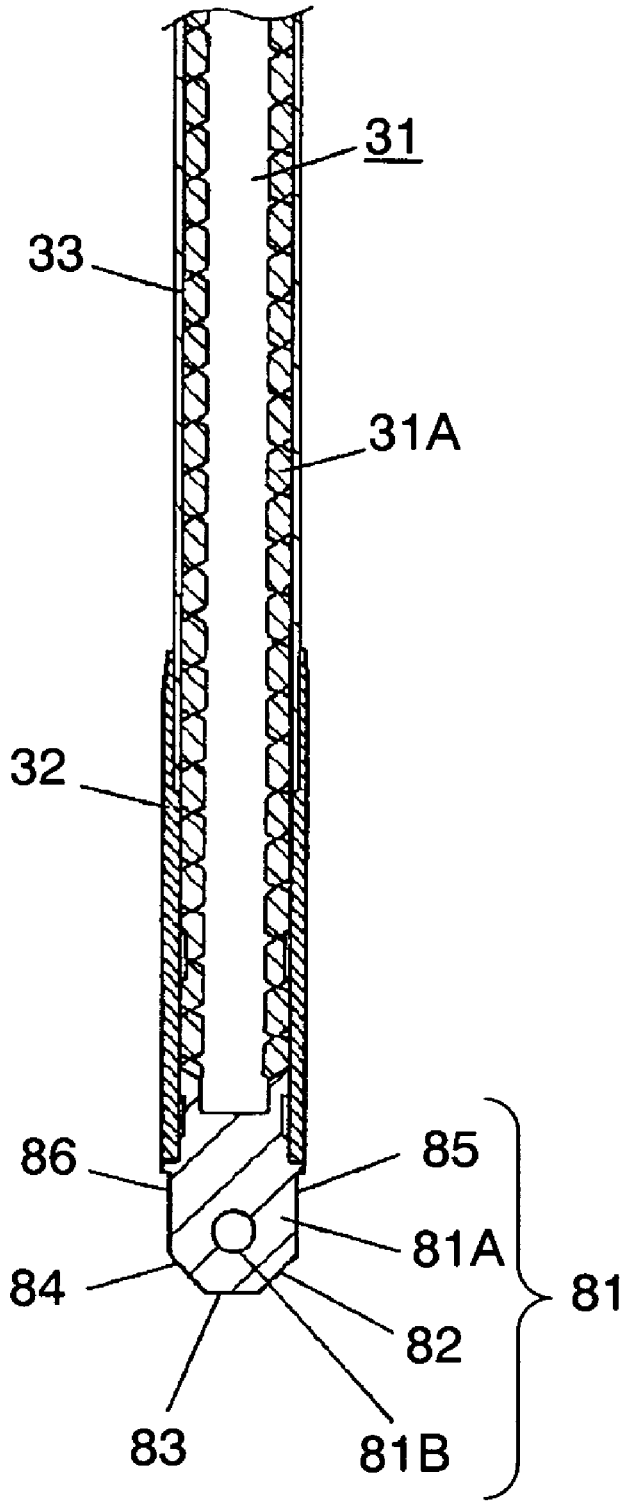
FIG. 3 is a cross-sectional view illustrating the lower part of the antenna rod as the main part of the antenna device according to the embodiment of FIG. 1.

FIG. 3 is a cross-sectional view illustrating in particular the lower part of antenna rod 31 (i.e., a part closer to antenna base 21). The lower outer circumference at the lower stage of antenna rod 31 is covered by metal tubular body 32. Metal tubular body 32 stores therein coil-like antenna element section 31A made of conductive wire. The upper part of the outer circumference of antenna element section 31A is covered by insulating tube 33.

At the lower stage of antenna rod 31, the respective end face sections of projection section 81A are shown. These end face sections are composed of: right inclined end face 82, horizontal lower end face 83, left inclined end face 84, right side end face 85, and left side end face 86.

Figure 4:
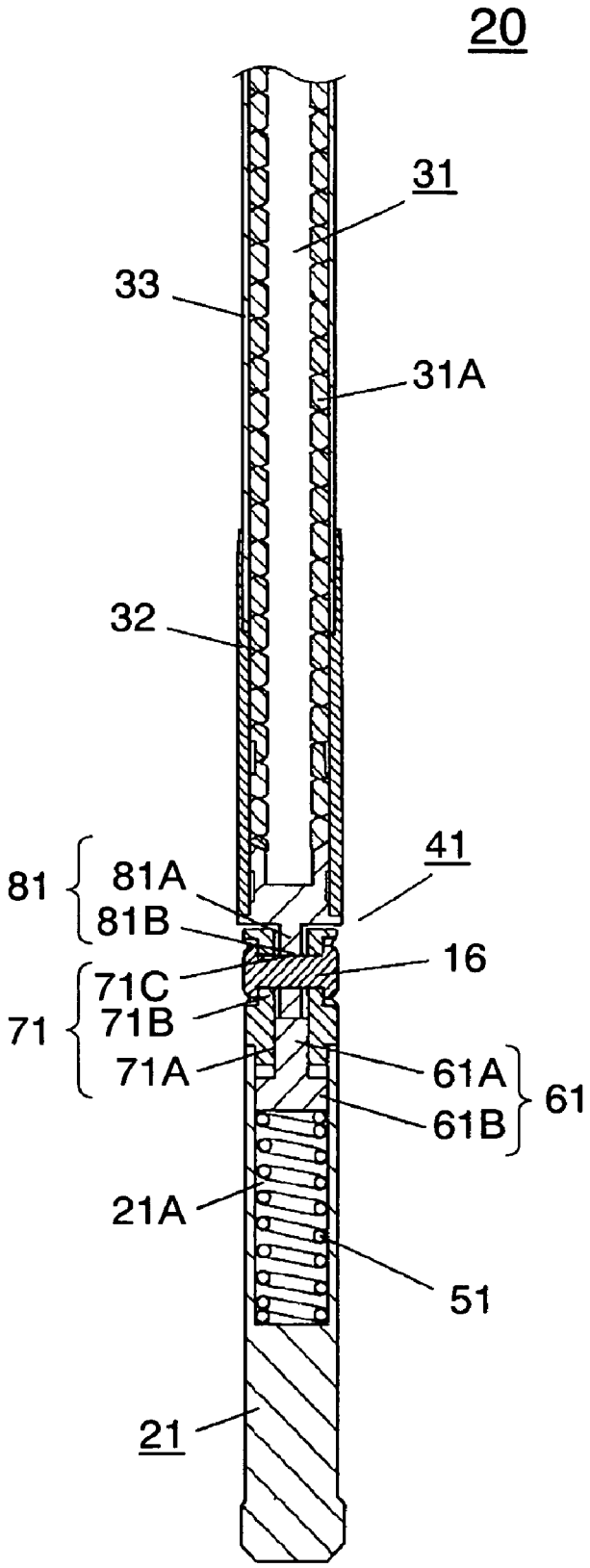
FIG. 4 is a cross-sectional view taken along line P-P of FIG. 1.

FIG. 4 is a cross-sectional view illustrating antenna device 20 taken at line P-P of FIG. 1. As in the conventional structure, projection section 81A of intermediate member 81 is provided between a pair of sandwiching plates 71B closer to antenna base 21. In this condition, axial support pin 16 is inserted into concentric penetration holes 71C and 81B and is calked at both sides to fix the connection so that antenna rod 31 can be turned around antenna base 21.

As seen in FIG. 1, antenna rod 31 is stopped at an angle of about 45 degrees to the right side relative to antenna base 21. Coil spring 51 stored in antenna base 21 is compressed to provide a predetermined biasing force. This biasing force biases abutting member 61 toward the upper side (i.e., toward hinge mechanism 41). As a result, the upper end of circular-cylindrical projection 61A is abutted with right inclined end face 82 at projection section 81A of intermediate member 81 so that antenna rod 31 is stopped with the above angle.

When antenna rod 31 is then turned around axial support pin 16 in the counterclockwise rotation direction, projection section 81A of intermediate member 81 is also turned in the same direction. During this turning, abutting member 61 is pushed by right inclined end face 82 of projection section 81A (see FIG. 3) to the lower side and is moved to the lower side of antenna base 21 so as to further compress coil spring 51 while providing the turning of projection section 81A.

Then, when the abutting position at the upper end of circular-cylindrical projection 61A (see FIG. 1) goes beyond the corner between right inclined end face 82 and horizontal lower end face 83 shown in FIG. 3, coil spring 51 pushes abutting member 61 upwardly to return to the original predetermined compression condition (over-center action). With assistance of this biasing force, the upper end of circular-cylindrical projection 61A of abutting member 61 is abutted with horizontal lower end face 83 of projection section 81A, thus stopping antenna rod 31. Specifically, this condition provides a balanced spring force with an angle at which the center line of antenna rod 31 and the center line of antenna base 21 are on a single line.

Figure 5:
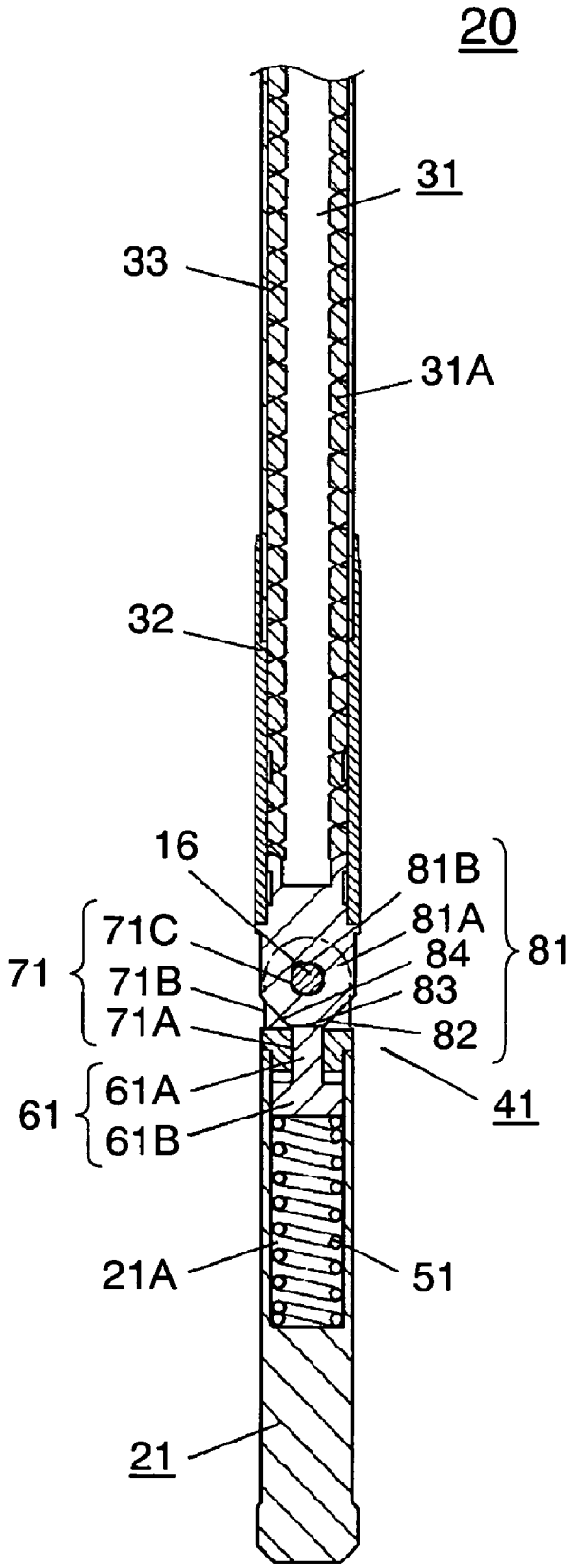
FIG. 5 is cross-sectional view according to the embodiment of present invention in which center lines of an antenna base and the antenna rod disposed on a single line.

FIG. 5 shows antenna device 20 according to the present invention with center lines of antenna base 21 and antenna rod 31 on a single line (i.e., the former and the latter are on a single straight line).

Similarly, when the condition of left inclined end face 84 (see FIG. 3) shown in FIG. 5 is changed to the condition in which left inclined end face 84 is abutted with the upper end of circular-cylindrical projection 61A of abutting member 61, antenna rod 31 is stopped while being inclined 45 degrees to the left side. Furthermore, when left side end face 86 (see FIG. 3) is abutted with the upper end of circular-cylindrical projection 61A of abutting member 61, antenna rod 31 is stopped while being inclined 90 degrees to the left side. When right side end face 85 (see FIG. 3) is abutted with the upper end of circular-cylindrical projection 61A of abutting member 61, antenna rod 31 is stopped while being inclined 90 degrees to the right side. An operation for changing these angle positions is the same as the above-described operation and thus will not be described further.

As described above, in one embodiment of the present invention, antenna device 20 including hinge mechanism 41 can stop antenna rod 31 at the respective five angle positions.

Then, when the angle position of antenna rod 31 is changed, antenna rod 31 is turned while allowing abutting member 61 to have a biased movement to the lower side (i.e., while allowing abutting member 61 to slide). When a corner of projection section 81A is exceeded, then the biasing force of coil spring 51 assists antenna rod 31 to stop. By simultaneously providing the above-described movement and function to hinge mechanism 41, the wear of the upper end of circular-cylindrical projection 61A due to the sliding (biased movement) of abutting member 61 can be prevented. Although this structure requires a predetermined load for changing the angle position of antenna rod 31 until an intermediate angle position is reached, a part exceeding the intermediate angle position can allow a user to operate the device with a light maneuvering feeling. Thus, antenna device 20 can provide superior operational feeling.

When coil spring 51 is preferably used as elastic material for biasing abutting member 61, coil spring 51 can be easily stored in antenna base 21 that is frequently formed to have a bar-like shape and abutting member 61 can be biased in a stable manner. However, other elastic materials also can be used, including rubber and an arcuate plate spring for example.

The lower part of projection section 81A of intermediate member 81 may be shaped in accordance with a desired angle at which antenna rod 31 is stopped. When the lower part of projection section 81A is formed to be partially in the shape of a regular polygon and has the center positioned at the center of the turning rotation of antenna rod 31 as described above, the same feeling can be preferably obtained whenever antenna rod 31 is turned from any of the respective angle positions.

Antenna device 20 having the structure as described above allows, via hinge mechanism 41, antenna rod 31 to be stopped at a predetermined angle position and also allows hinge mechanism 41 to have reduced wear compared with that in the conventional structure. By this structure, antenna rod 31 can be stopped at an angle position determined by a user, for a long time and in a stable manner.

This structure also provides intermediate member 81 in addition to antenna rod 31. Thus, intermediate member 81 can be formed by material having a high strength. This structure can prevent, even when a user unintentionally drops a wireless device attached with antenna rod 31, antenna device 20 and hinge mechanism 41 from having damage or breakage. This also applies to cover section 71 at the antenna base 21. When a plurality of intermediate members having projection sections having different shapes are selectively attached to antenna rod 31, a few types of antenna devices 20 by which antenna rod 31 is stopped at different angle positions can be widely provided depending on the desired application.

Figure 6:
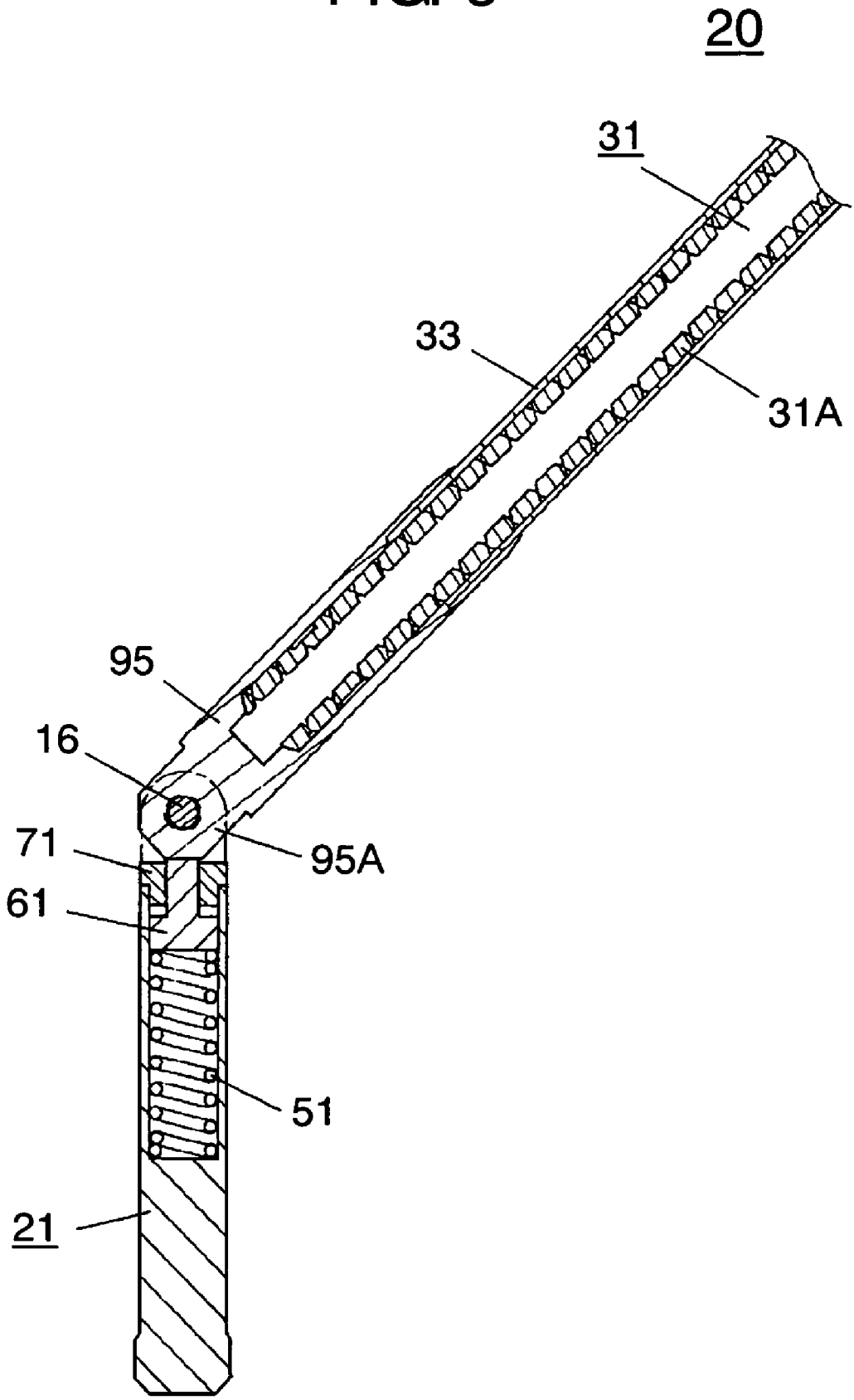
FIG. 6 is a cross-sectional view illustrating another configuration of the antenna device according to the present invention.

FIG. 6 shows another antenna device 20 according to the present invention. Antenna base 21 includes axial support pin 16. Axial support pin 16 is connected to antenna rod 31. Antenna base 21 stores therein coil spring 51. At the upper part of coil spring 51, abutting member 61 is provided. At the upper part of abutting member 61, cover section 71 attached to antenna base 21 is provided.

Furthermore, antenna device 20 shown in FIG. 6 has a structure that uses tubular section-attached intermediate member 95 covering the lower part of antenna element section 31A. At the lower end of intermediate member 95, projection section 95A is formed that partially forms a polygon when seen from the side. The end face of projection section 95A is abutted with abutting member 61. This structure can reduce the number of components and the number of assembly steps.

Antenna rod 31 also may have another structure other than the two-stage one and the structure of antenna element section 31A is also not particularly limited.

Furthermore, the shape of projection section 81A shown in FIG. 3, FIG. 4, and FIG. 5 is not limited to the one partially forming a regular polygon and also may be, in addition to a polygon, a circular arc-like shape by which the antenna rod may be stopped at any angle position by being abutted with an abutting member.

INDUSTRIAL APPLICABILITY

The antenna device according to the present invention has a hinge mechanism by which an abutting member biased toward an antenna rod by elastic material is abutted with an end section in the antenna rod, thereby allowing the above antenna rod to stop at a predetermined angle position. The hinge mechanism allows the antenna rod to be moved to a different angle position while allowing the abutting member to have a biased movement. This can provide an effect according to which wear at the abutting position can be reduced for example so that the antenna device can be stopped at a determined angle position for a long time and in a stable manner. This antenna device is useful for various wireless devices such as television receivers, radio receivers and the like.

The invention claimed is:

1. An antenna device for coupling a base end of an antenna rod to a free end of an antenna base such that the antenna rod is stopped at predetermined angular positions relative to the antenna base, said antenna device comprising:

an intermediate member to be coupled to the base end of the antenna rod, said intermediate member comprising a projection section to be projected toward the antenna base;

an abutting member comprising a base section and a projection, said projection of said abutting member projecting from said base section of said abutting member toward said projection section of said intermediate member, said intermediate member being pivotal between plural pivot positions relative to said abutting member;

a biasing member-receiving section to be provided to the antenna base; and an elastic biasing member provided in said biasing member-receiving section and acting upon said base section of said abutting member to bias said abutting member toward said intermediate member such that said projection of said abutting member yieldingly presses against said projection section of said intermediate member;

wherein said projection section of said intermediate member comprises a projection plate having an abutting end face that abuts against said projection of said abutting member; and wherein said abutting end face of said projection plate is shaped as a section of a polygon which has plural end faces inclined with respect to each other and which has no outwardly facing recesses that abut with said projection of said abutting member; and wherein said plural end faces are configured and arranged such that, when said intermediate member is in a first of said pivot positions relative to said abutting member, said projection of said abutting member presses against only a first one of said plural end faces and, when said intermediate member is in a second of said pivot positions relative to said abutting member, said projection of said abutting member presses against only a second one of said plural end faces.

2. The antenna device according to claim 1, wherein said projection plate of said intermediate member, said projection of said abutting member and said elastic biasing member are arranged and configured such that, upon pivoting of said intermediate member relative to said abutting member such that said projection of said abutting member slides along one of said plural end faces of said projection plate toward an adjacent one of said plural end faces, said elastic biasing member causes an over-center action by which said projection of said abutting member is pushed by said elastic biasing member to cause further pivoting of said intermediate member relative to said abutting member once said projection is moved beyond a vertex between said adjacent ones of said plural end faces of said projection plate.

3. The antenna device according to claim 2, wherein said abutting end face of said projection plate is shaped as a section of a regular polygon.

4. The antenna device according to claim 3, wherein said abutting member and said elastic biasing member are provided to said biasing member receiving section such that said elastic biasing member biases said abutting member to move along a base axis; and an abutting end face of said projection of said abutting member comprises a planar end face that is substantially perpendicular to said base axis.

5. The antenna device according to claim 1, wherein said abutting end face of said projection plate is shaped as a section of a regular polygon.

6. The antenna device according to claim 5, wherein said regular polygon comprises an octagon.

7. The antenna device according to claim 5, wherein said abutting member and said elastic biasing member are provided to said biasing member receiving section such that said elastic biasing member biases said abutting member to move along a base axis; and an abutting end face of said projection of said abutting member comprises a planar end face that is substantially perpendicular to said base axis.

8. The antenna device according to claim 1, wherein said elastic biasing member comprises a coil spring.

9. The antenna device according to claim 1, wherein said base section of said abutting member comprises a circular base section; and said projection of said abutting member comprises a circular-cylindrical projection.

10. An antenna device comprising:

an antenna base having a base end to be coupled to a wireless device, and a free end opposite said base end;

an antenna rod having a base end pivotally coupled to said free end of said antenna base such that said antenna rod is stopped at predetermined angular positions relative to said antenna base;

an intermediate member coupled to said base end of the antenna rod, said intermediate member comprising a projection section projected toward said antenna base;

an abutting member comprising a base section and a projection, said projection of said abutting member projecting from said base section of said abutting member toward said projection section of said intermediate member, said intermediate member being pivotal between plural pivot positions relative to said abutting member;

a biasing member-receiving section provided to said antenna base; and an elastic biasing member provided in said biasing member-receiving section and acting upon said base section of said abutting member to bias said abutting member toward said intermediate member such that said projection of said abutting member yieldingly presses against said projection section of said intermediate member;

wherein said projection section of said intermediate member comprises a projection plate having an abutting end face that abuts against said projection of said abutting member; and wherein said abutting end face of said projection plate is shaped as a section of a polygon which has plural end faces inclined with respect to each other and which has no outwardly facing recesses that abut with said projection of said abutting member; and wherein said plural end faces are configured and arranged such that, when said intermediate member is in a first of said pivot positions relative to said abutting member, said projection of said abutting member presses, against only a first one of said plural end faces and, when said intermediate member is in a second of said pivot positions relative to said abutting member, said projection of said abutting member presses against only a second one of said plural end faces.

11. The antenna device according to claim 10, wherein said projection plate of said intermediate member, said projection of said abutting member and said elastic biasing member are arranged and configured such that, upon pivoting of said intermediate member relative to said abutting member such that said projection of said abutting member slides along one of said plural end faces of said projection plate toward an adjacent one of said plural end faces, said elastic biasing member causes an over-center action by which said projection of said abutting member is pushed by said elastic biasing member to cause further pivoting of said intermediate member relative to said abutting member once said projection is moved beyond a vertex between said adjacent ones of said plural end faces of said projection plate.

12. The antenna device according to claim 11, wherein said abutting end face of said projection plate is shaped as a section of a regular polygon.

13. The antenna device according to claim 12, wherein said abutting member and said elastic biasing member are provided to said biasing member receiving section such that said elastic biasing member biases said abutting member to move along a base axis; and an abutting end face of said projection of said abutting member comprises a planar end face that is substantially perpendicular to said base axis.

14. The antenna device according to claim 10, wherein said abutting end face of said projection plate is shaped as a section of a regular polygon.

15. The antenna device according to claim 14, wherein said regular polygon comprises an octagon.

16. The antenna device according to claim 14, wherein said abutting member and said elastic biasing member are provided to said biasing member receiving section such that said elastic biasing member biases said abutting member to move along a base axis; and an abutting end face of said projection of said abutting member comprises a planar end face that is substantially perpendicular to said base axis.

17. The antenna device according to claim 10, wherein said elastic biasing member comprises a coil spring.

18. The antenna device according to claim 10, wherein said base section of said abutting member comprises a circular base section; and said projection of said abutting member comprises a circular-cylindrical projection.

19. The antenna device according to claim 10, wherein a pivot center about which said antenna rod pivots relative to said antenna base is located at a center of said polygon.

* * * * *

UNITED STATES PATENT AND TRADEMARK OFFICE

CERTIFICATE OF CORRECTION

PATENT NO. : 7,358,926 B2
APPLICATION NO. : 11/398722
DATED : April 15, 2008
INVENTOR(S) : Shinzo Komoto et al.

It is certified that error appears in the above-identified patent and that said Letters Patent is hereby corrected as shown below:

Claim 1:

In column 8, line 25, after the word "and" the word "wherein" should be the start of a new paragraph.

Claim 10:

In column 9, line 52, after the word "and" the word "wherein" should be the start of a new paragraph.

In column 9, line 56, "member presses, against only" should read --member presses against only--.

Signed and Sealed this

Second Day of September, 2008

JON W. DUDAS
*Director of the United States Patent and Trademark Office*